US005195849A

United States Patent [19]

Stapleton

[11] Patent Number: 5,195,849

[45] Date of Patent: Mar. 23, 1993

[54] TRENCH SHORING APPARATUS

[76] Inventor: Thomas J. Stapleton, 15821A Timbervalley, Chesterfield, Mo. 63017

[21] Appl. No.: 850,262

[22] Filed: Mar. 12,.1992

[51] Int. Cl.[5] ..... E02D 17/00

[52] U.S. Cl. ..... 405/282; 52/155; 405/272

[58] Field of Search ..... 405/272, 282, 283, 284, 405/285, 286; 52/155, 165

[56] References Cited

U.S. PATENT DOCUMENTS

| | | | |
|---|---|---|---|
| 443,622 | 12/1890 | Amos | 52/165 X |
| 991,981 | 5/1911 | Havard | 405/272 |
| 1,935,704 | 11/1933 | Fields et al. | 405/272 |
| 2,482,367 | 9/1949 | Ravers | 405/282 |
| 3,470,699 | 10/1969 | Cox | 405/282 |
| 3,910,053 | 10/1975 | Krings | 405/282 |
| 4,487,530 | 12/1984 | Morrice | 405/282 |
| 4,993,880 | 2/1991 | Collins | 405/282 |
| 5,080,533 | 1/1992 | Cooper | 405/282 |

*Primary Examiner*—David H. Corbin
*Attorney, Agent, or Firm*—Richard C. Litman

[57] ABSTRACT

A trench shoring apparatus braces the substantially vertical walls of an earthen excavation. Telescoping wall support legs permit the apparatus to be easily adjusted for use in trenches of various depths. Horizontal wall support arms joined to the wall support legs retain and stabilize trench wall soils and provide a mechanism for mounting additional soil retaining components. Flexible anchor support arms transfer the load produced by the shifting trench walls to a location remote from the trench. The trench shoring apparatus, additionally, may be partially folded and disassembled for ease in transportation and storage.

18 Claims, 4 Drawing Sheets

TRENCH SHORING APPARATUS

FIELD OF THE INVENTION

The present invention relates to the shoring, bracing, and cave-in prevention of earthen trenches. In particular, it relates to a novel and improved trench shoring apparatus that is portable, lightweight, adjustable in height, and adjustable to the terrain immediately surrounding a given trench excavation.

BACKGROUND OF THE INVENTION

Throughout the United States innumerable earthen trenches are excavated annually. Such trenches are employed in the construction of engineering structures ranging from building foundations to sewer lines. The laborers assembling such structures are often required to work within these trenches. Often they are fatally injured while doing so.

While trenches may be excavated to a depth greater than a man's height, they seldom penetrate the relatively unconsolidated soils or sediments that overlay solid bedrock below. This unconsolidated matter is usually a mixture of decaying vegetative material and fine-grained wind or water borne minerals. When exposed by an excavation such as a trench, these materials have proven to be extremely unstable and prone to cave-in under the slightest load. Thus, the possibility of an excavation's collapse is always substantial. Indeed, it has been estimated that two hundred fatalities caused by trench cave-ins occur within the United States each year.

Construction companies are notoriously lax in obeying regulations promulgated by government agencies. Regulations of the Occupational Health and Safety Administration (OSHA), for instance, mandate that trenches or excavations of a depth greater than an established minimum must be sloped or shored. As the sloping of excavations is a time consuming process requiring the movement of earthen material beyond that absolutely necessary for construction purposes, it is avoided when possible to reduce expenditures. Additionally, the trench boxes currently available for shoring trenches are time consuming to erect at construction sites due to their large size, weight, and complexity. Beyond this, trench box cross braces restrict and impede free movement within the trench as well as the rate at which work can be performed. Since construction companies usually establish goals of performing assignments as rapidly as possible, neither trench shoring nor sloping operations are performed without great hesitation and reluctance. As long as this remains the case, the risk to human life at construction sites will remain unnecessarily high.

The need has arisen for an apparatus which will prevent the cave-in of an earthen trench and may be erected rapidly at the construction site.

DESCRIPTION OF THE RELATED ART

In the past, devices have been developed to prevent the collapse of earthen trench walls. One such device utilizes two panels positioned opposite one another against the two walls of a trench. Cross members spanning the distance between such panels bear the forces transmitted from earthen wall and provide for its support. This "trench box" apparatus has become well known in the art. An example of such a device is contained in U.S. Pat. No. 4,993,880 to John Collins granted Feb. 19, 1991. This device's great weight and bulk make it difficult to transport and time consuming to install. These drawbacks frequently prevent its use when worker safety would otherwise demand it.

A second type of device for shoring trenches is illustrated in U.S. Pat. No. 991,981, granted May 9, 1911, to Albert H. Harvard. Harvard's patent discloses a grave brace that transmits the load produced by shifting trench wall sediments to staked members located outside the trench and upon the ground's surface. While an improvement, in terms of portability, over the trench box, Harvard's device is only capable of shoring a very shallow trench, and transmits no portion of the trench wall load to the trench floor.

None of the above inventions and patents, taken either singly or in combination, is seen to describe the instant invention as claimed.

SUMMARY OF THE INVENTION

By the present invention, an improved trench shoring apparatus for use in supporting the walls of an excavated earthen trench.

Accordingly, it is a principal object of this invention to provide a trench shoring apparatus such that its horizontal load bearing members may be placed upon the ground's surface outside of the trench allowing unimpeded movement therein.

It is a secondary object of this invention to provide a trench shoring apparatus such that its wall supporting legs span the trench's height and firmly insert into the trench floor.

It is another object of this invention to so construct a trench shoring apparatus wherein its height may be adjusted to accommodate trenches of various depths.

Still another object of the present invention is to provide a trench shoring apparatus that may be readily adapted to terrain of varying relief surrounding a given trench excavation.

It is a further object of the present invention to construct a trench shoring apparatus of lightweight components which can be easily disassembled and moved.

It is an additional object of this invention to provide a trench shoring apparatus of compact size for ready storage when not in use.

It is the object of this invention to provide improved elements and arrangements thereof in a trench shoring apparatus for the purposes described which is inexpensive, dependable and fully effective in accomplishing its intended purposes.

These and other objects of the present invention will become readily apparent upon further review of the following specification an drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
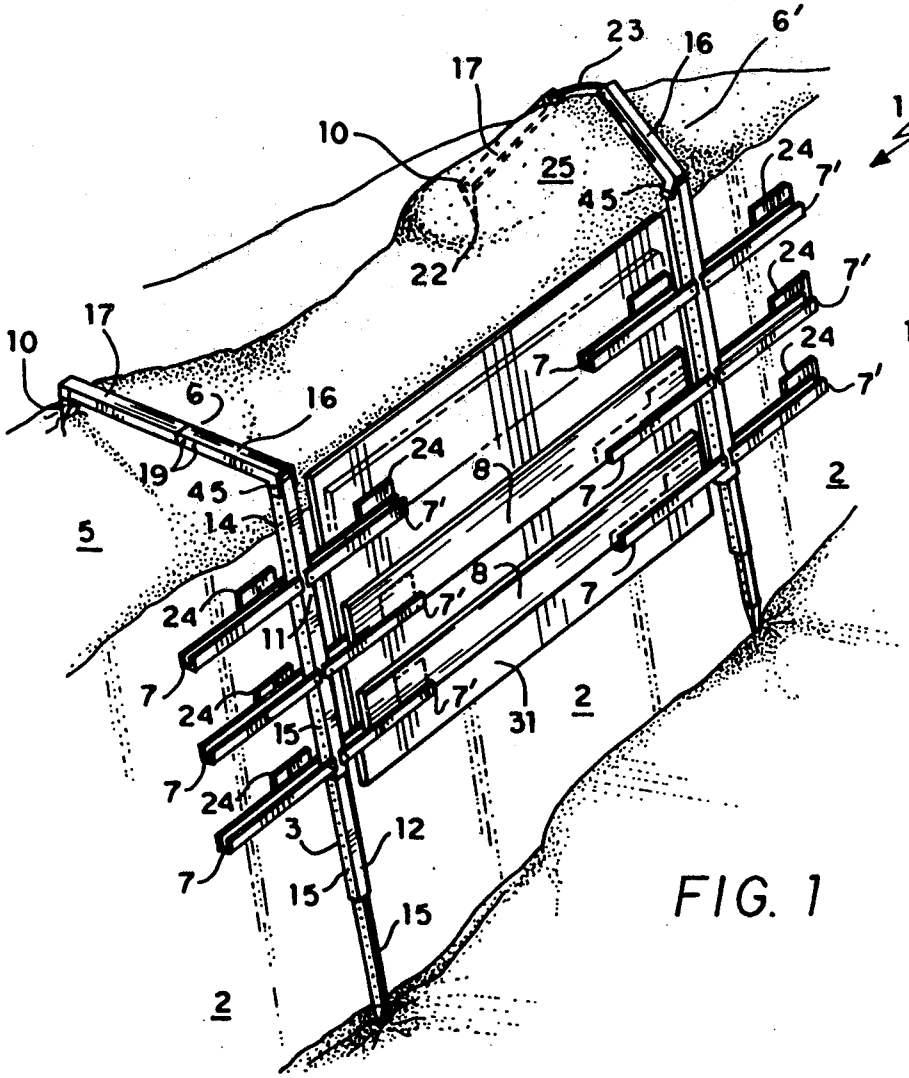
FIG. 1 is a perspective and environmental view of a trench shoring apparatus within a trench.
Figure 3:
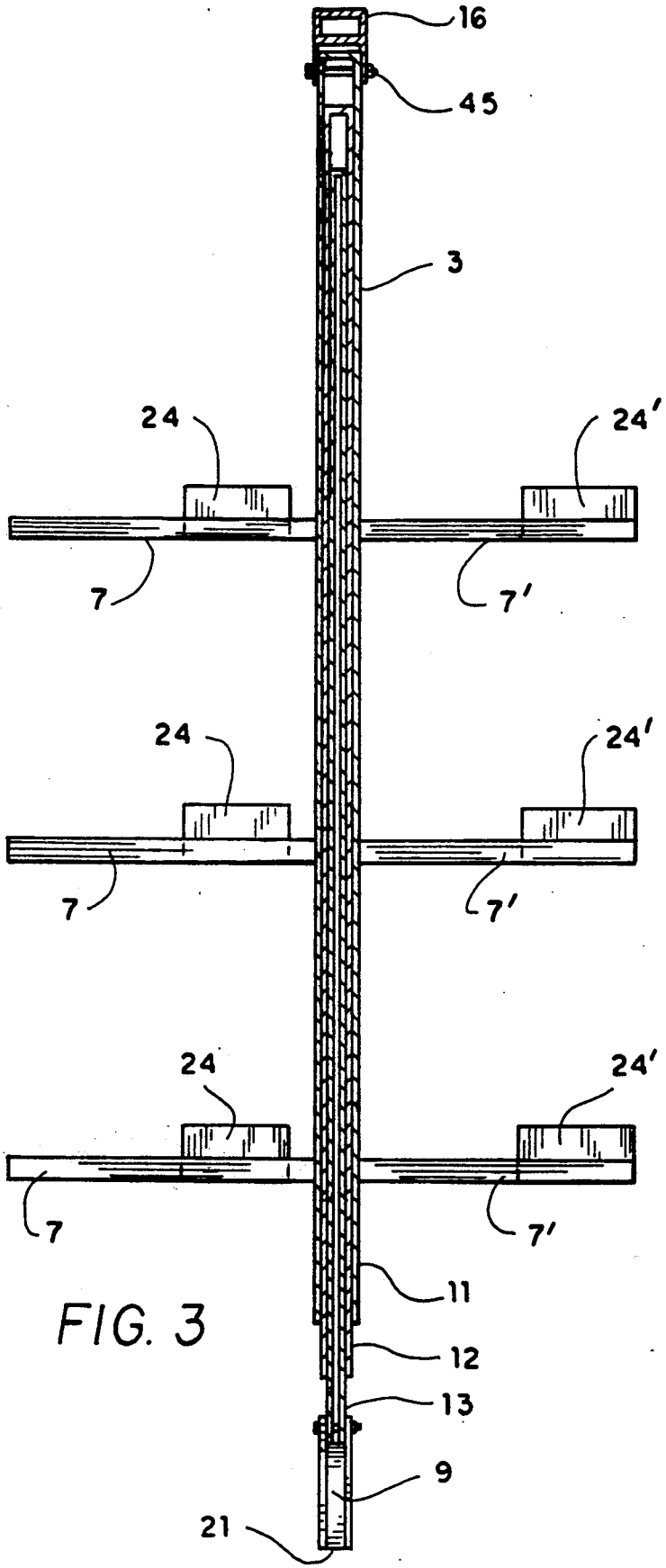
FIG. 3 is front elevational and cross sectional view of a trench shoring apparatus.

Referring now to the drawings, there is shown in FIG. 1 a trench shoring apparatus 1 for use by persons in the construction industry or the like, such apparatus being temporarily secured against an earthen trench wall 2. The shoring apparatus 1 has several primary load bearing members. Vertical wall support legs 3, 3' extend from the trench floor 4 to the ground surface 5 above. The vertical wall support legs 3, 3' are held firmly against the trench wall 2 by hollow anchor members 6, 6'. Loads generated by shifting trench soils exerted upon support legs 3, 3' are transmitted to the ground surface 5 through the anchor members 6, 6'. Hollow anchor members 6, 6' are of a length sufficient to reach beyond the slump zone of the earthen material to be shored. The width of this slump zone has been defined in the soil mechanics art as a function of the earthen material's angle of repose and excavation depth. Additionally, anchor members 6, 6' support the trench wall 2 with sufficient strength to provide the required margin of safety for those entering the trench. Finally, attached to vertical wall support legs 3, 3' are horizontal support arms 7, 7'. The support arms 7, 7' provide additional support to the trench wall 2 and provide a U-shaped seat wherein wall support members 8 may be joined to vertical wall support legs 3, 3'.

The trench shoring apparatus 1 may be firmly affixed to the earth. Anchoring daggers 9 are joined to the ends of vertical wall support legs 3, 3'. The V-shaped daggers 9 may be inserted into the trench floor 4 preventing horizontal movement of the support legs 3, 3' when under loads from shifting trench wall soils. On the other hand, stakes 10, attached to the ends of anchor members 6, 6', are provided with similar V-shaped cross sections and are capable of being driven into the ground surface 5.

Figure 2:
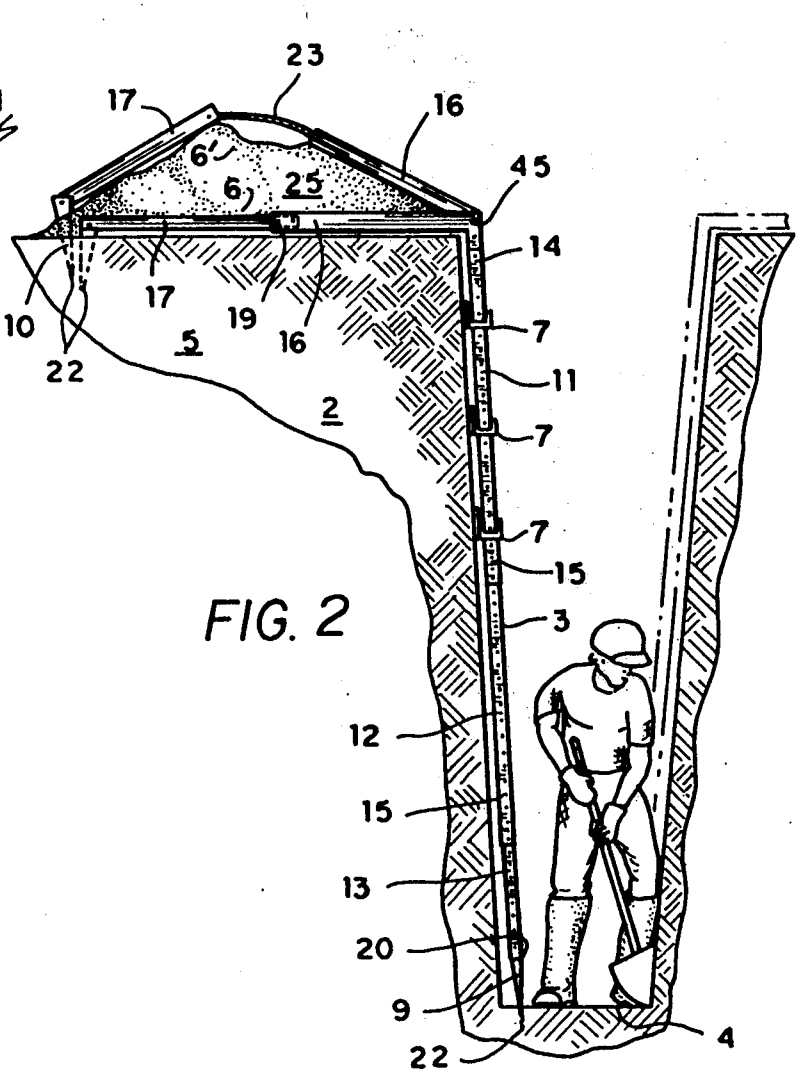
FIG. 2 is a side elevational and environmental view of a trench shoring apparatus within a trench.

In order to secure an optimal fit of the trench shoring apparatus 1 within a trench, minimize shipping difficulties, and reduce the volume for storage, several of the apparatus' components telescope within each other. Vertical support legs 3, 3' are each constructed of three nested and telescoping tubes 11, 12, and 13. In the preferred embodiment, tubes 11, 12, and 13 have a square cross section. When the vertical support legs 3, 3' are reduced to a minimum, tube 11, having the largest cross sectional area, houses both tubes 12 and 13 having progressively smaller cross sectional areas. Similarly, tube 12, which is slightly larger than tube 13, houses tube 13 when the length of either vertical support leg 3, 3' is reduced. Two series of linearly arranged and opposing holes 14 seen in FIGS. 1 and 2 run the length of tubes 11, 12, and 13 permit removable pins 15 to join tubes 11, 12, and 13. Pins 15 may be removed as desired allowing the length of vertical support legs 3, 3' to be adjusted to fit the exact height of a trench wall 2. In the preferred embodiment, vertical support legs 3, 3' may be telescoped to approximately three times the retracted legs' length. With the tubes 11, 12, and 13 retracted, the apparatus 1 may be most easily stored and transported.

Hollow anchor members 6, 6' are each constructed of two nested and telescoping tubes 16, 17. In the preferred embodiment, the tubes 16 and 17 have a square cross section. Tube 16, having dimensions larger than those of tube 17, houses the latter when the length of anchor members 6, 6' are reduced to a minimum for storage purposes. A hole piercing tubes 16, 17 permits a removable pin 19 to join tubes 16, 17 when inserted therein. With tubes 16, 17 joined by pin 19, the trench shoring apparatus 1 may be employed in normal trench shoring operations.

Figure 4:
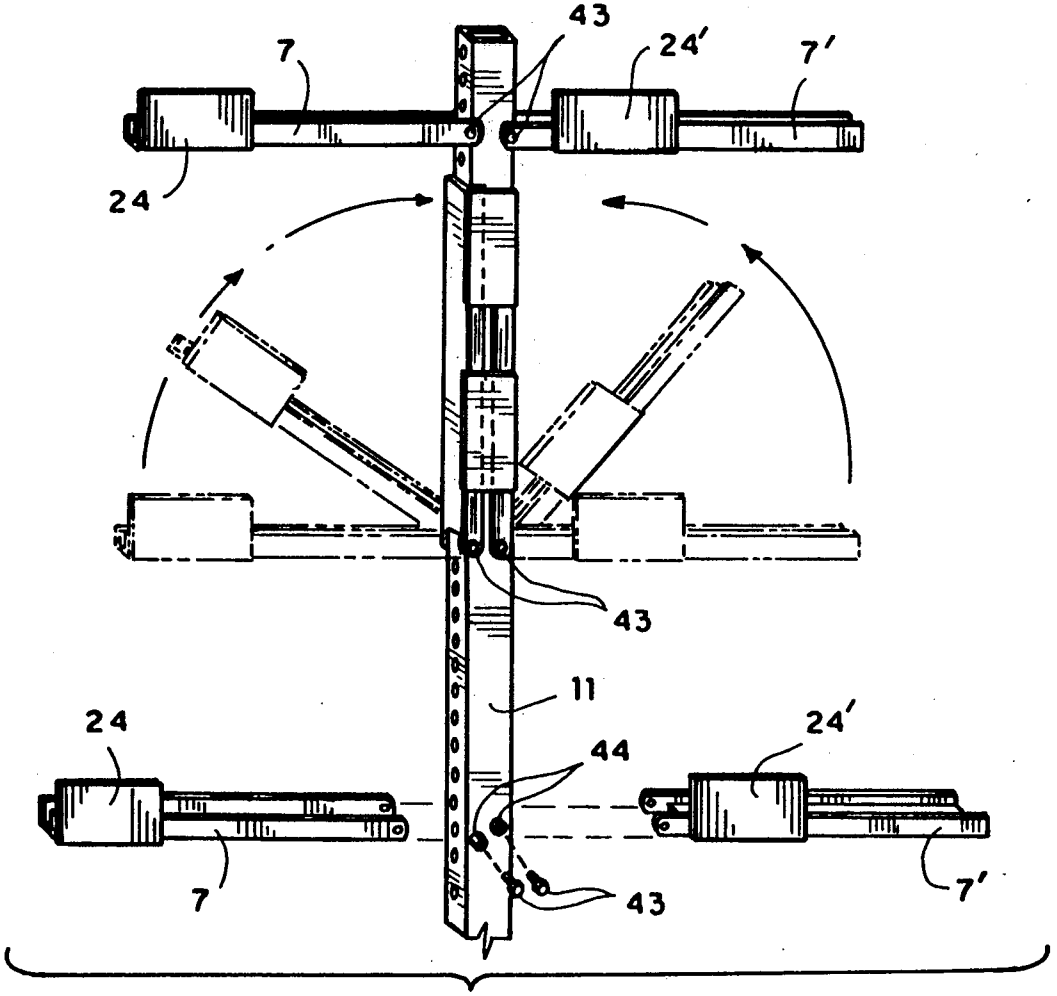
FIG. 4 is a rear elevational and detail view of a trench shoring apparatus showing pivoting horizontal support arms.

Several of the preferred embodiment's components pivot upon each other in order to enhance its ability to be transported from one construction site to another or to reduce its volume for storage. First, V-shaped daggers 9 are pivotly joined to the ends of vertical support legs 3, 3'. The daggers 9 may pivot on pins 20 inserted through daggers 9 and telescoping tubes 13. The apparatus is constructed such that each dagger's pointed tip 21 may only pivot away from the trench wall 3 when employed in trench shoring operations. In this manner, a horizontal force exerted upon the support legs 3, 3' by the slumping or shifting trench wall 2 will lock the daggers 9 and support legs 3, 3' in a vertical position. Additionally, V-shaped stakes 10 are pivotly joined to the ends of anchor members 6, 6'. The stakes 10 may pivot on pins inserted through each of stakes 10 and telescoping tubes 17. The trench shoring apparatus 1 is constructed such that each stake's pointed tip 22 may pivot only toward the trench wall 3 when employed in trench shoring operations. In this manner, a horizontal force exerted upon the support legs 3, 3' will lock stakes 10 in a position substantially perpendicular to anchor members 6, 6'. Finally, as may be seen in FIG. 4, horizontal support arms 7, 7' may pivot vertically upon bolts 43 threaded into nuts 44 joined to vertical support legs 3, 3'. Joined to the support arms 7, 7' are reinforcing flanges 24, 24'. Reinforcing flanges 24, 24' are constructed such that the flange 24 pivots on a smaller radius than flange 24'. Thus, when fully pivoted against tube 11, flanges 24 and 24' do not contact each other.

It has been recognized that the ground surface 5 and trench wall 2 are seldom exactly perpendicular to each other. For this reason, anchor members 6, 6' are pivotly attached to vertical support legs 3, 3' by pins 45. Pins 45 permit anchor members 6, 6' to lay upon the ground surface 5, provided that such surface is relatively flat, regardless of the angle formed between the trench wall 2 and the surface 5.

Figure 5:
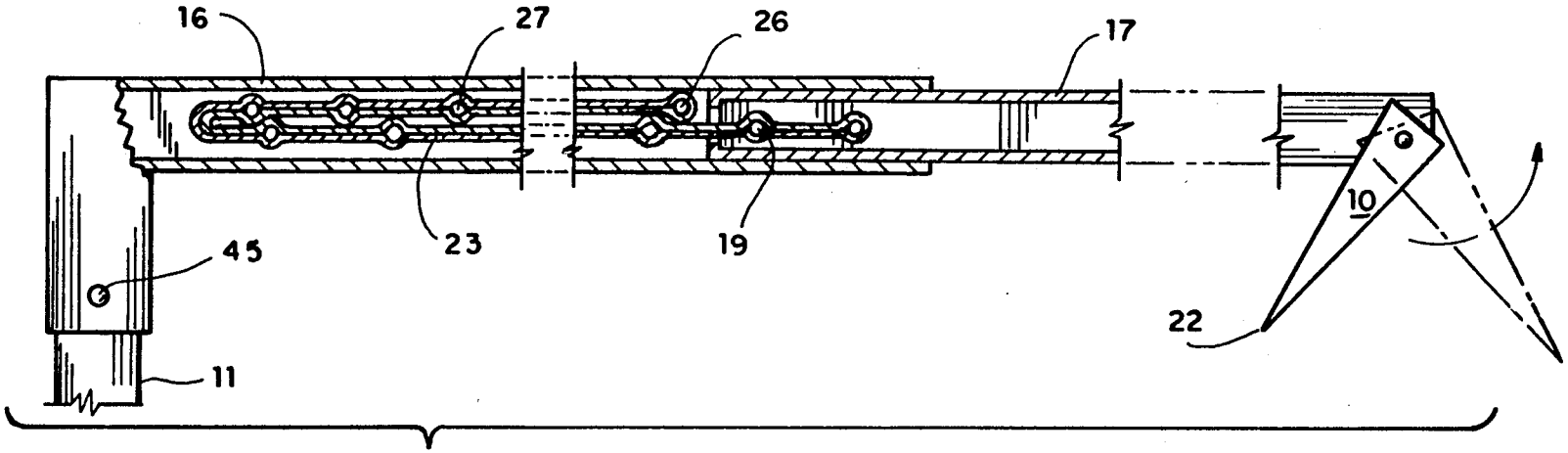
FIG. 5 is a side elevational, cross sectional, and detail view of an anchor member and flexible strap stored therein.

As the ground surface 5 adjacent to a trench wall 2 is sometimes undulating, anchor members 6, 6' are constructed such that tubes 16 and 17 may be connected by a flexible fabric strap 23 rather than pin 19. The flexible strap 23 permits anchor members 6, 6' to hinge and conform to irregular terrain adjacent to the trench wall 2. FIG. 1 shows the anchor member 6 in the usual operative mode upon a substantially planar ground surface with tubes 16 and 17 connected by pin 19. Also shown in FIG. 1 is anchor member 6' wherein tubes 16 and 17 are joined by a strap 23. The strap 23 permits anchor member 6' to extend over an earthen berm 25 adjacent to the trench wall 2 allowing stake 10 to be inserted into consolidated soil beyond. The exposed length of the strap 23 may be adjusted, as shown in FIG. 5, by inserting a removable pin 26 into one of the retaining loops 27 sewn into the strap 23.

Figure 6:
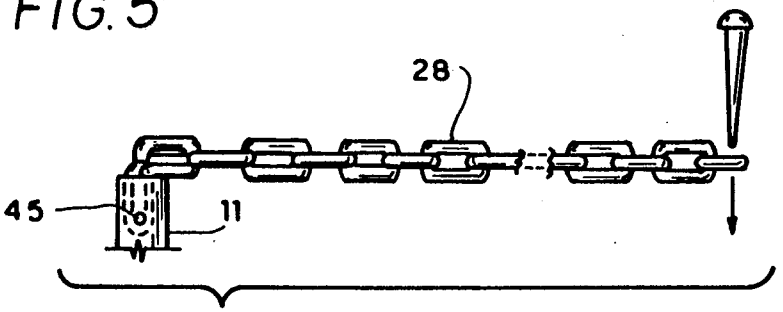
FIG. 6 is a side elevational and detail view of an alternative embodiment of a trench shoring apparatus with an anchor member having a chain.
Figure 7:
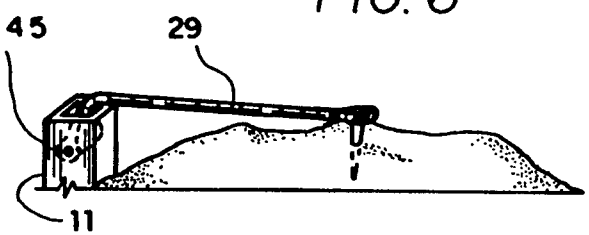
FIG. 7 is a side elevational and detail view of an alternative embodiment of a trench shoring apparatus with an anchor member having a cable.
Figure 8:
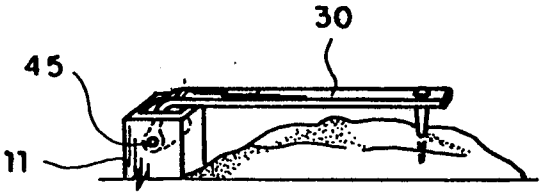
FIG. 8 is a side elevational and detail view of an alternative embodiment of a trench shoring apparatus with an anchor member having a strap.

It has been contemplated that anchor members having alternate forms of construction yet having the equivalent strength and weight of anchor members 6, 6' may be employed in the subject apparatus 1. A chain, a cable, or a strap, among others, may be employed as effective substitutes for anchor members 6, 6'. FIG. 6 shows a chain 28 employed as an anchor member. FIGS. 7 and 8 respectively show a cable 29 and a strap 30 employed as substitutes for anchor members 6, 6'.

Referring back to FIG. 1, the preferred embodiment of the trench shoring apparatus 1 is shown with two vertical support legs 3, 3' laterally spaced upon trench wall 2. When in use at other construction sites or the like, any number of similar vertical support legs may be employed as required. These additional support legs would be equivalently spaced along a trench wall and may be connected to each other with lateral wall support members 8. Lateral wall support plates 31 may also be added.

Maximum support for the trench wall 2 is provided when lateral wall support members 8 are placed within opposing horizontal support arms 7, 7'. The U-shaped support arms 7, 7' cradle and retain the lateral wall support members 8. Between the lateral wall support members 8 and the trench wall is placed a lateral wall support plate 31. The plate 31 retains earthen material within the trench wall 2. It is contemplated that the support plate 31 may be constructed from a variety of materials: wood, iron, aluminum, etc., and in a variety of configurations such that the entire trench wall 2 or a fraction thereof may be supported by the plate 31. When it is desired that support plate 31 be suspended above the trench floor 4 as seen in FIG. 1, fasteners may be employed to join plate 31 to horizontal support arms 7, 7'.

It is to be understood that the present invention is not limited to the sole embodiment described above, but encompasses any and all embodiments within the scope of the following claims.

I claim:

1. A trench shoring apparatus for use in the shoring, bracing, and cave-in prevention of earthen trenches comprising:

a vertical wall support leg, adapted to extend substantially vertically from a trench's floor to the ground's surface above;

a plurality of horizontal support arms joined to said support leg and adapted to receive lateral wall support members, said horizontal support arms being pivotally joined to said support leg; and, an anchor means joined to said support leg, whereby loads generated by shifting trench wall soils exerted upon said support legs are transmitted to the ground's surface through said anchor means and said arms may be rotated into a position substantially parallel to said support leg to reduce the width of said trench anchoring apparatus permitting easy storage thereof when not in use.

2. The trench shoring apparatus of claim 1 wherein said vertical wall support leg includes:

a plurality of nested support members, whereby said support members may be moved relative to one another and telescoped to permit use of said trench shoring apparatus in trenches of varying depths.

3. The trench shoring apparatus of claim 1 wherein said vertical support leg includes:

an anchor dagger, said dagger joined to the bottom of said support leg, whereby said dagger may be inserted into the trench floor preventing horizontal movement of said support leg when under load from shifting trench wall soils.

4. The trench shoring apparatus of claim 3 wherein said anchoring dagger is pivotally joined to the bottom of said support leg. whereby said dagger may be rotated into a position substantially parallel to said support leg reducing the length of said trench shoring apparatus permitting easy storage thereof when not in use.

5. The trench shoring apparatus of claim 1 wherein said anchor means includes:

a plurality of hollow anchor members;

a flexible connecting means joining said anchor members, whereby said flexible connecting means allows said anchor members to hinge and conform to irregular terrain adjacent to a trench excavation; and, a stake joined to one of said hollow anchor members, said stake adapted to penetrate the earth.

6. The trench shoring apparatus of claim 5 wherein said plurality of hollow anchor members nest within one another and are adapted to be telescopically extended or retracted, whereby the length of said anchor means may be reduced permitting easy storage thereof when not in use.

7. The trench shoring apparatus of claim 5 wherein said flexible connecting means comprises:

a flexible strap.

8. The trench shoring apparatus of claim 5 wherein said stake is pivotally joined to one of said hollow anchor members, whereby said stake may be rotated into a position substantially parallel to said adjoining hollow anchor members permitting easy storage thereof when not in use.

9. The trench shoring apparatus of claim 1 wherein said anchor means comprises one of:

a linked chain, a cable, and fabric strap.

10. A trench shoring apparatus for use in shoring, bracing, and cave-in prevention of earthen trenches comprising:

a plurality of vertical wall support legs, said legs adapted to extend substantially vertically from a trench's floor to the ground's surface above;

a means for anchoring each of said wall support legs, whereby loads generated by shifting trench wall soils exerted upon each of said support legs are transmitted to the ground's surface through said anchoring means;

a plurality of horizontal support arms joined to each said support leg, said horizontal support arms being pivotally joined to each of said support legs;

a plurality of lateral wall support members removably joined to said support arms, whereby each of said support members extends horizontally along the trench wall and connects two of said vertical support legs adjacently positioned against the trench wall; and, a plurality of lateral wall support plates, said plates positioned between the trench wall and said lateral wall support members, whereby each of said support plates provides additional support for the trench wall and said arms may be rotated into a position substantially parallel to each said support leg joined thereto to reduce the width of said trench anchoring apparatus permitting easy storage when not in use.

11. The trench shoring apparatus of claim 10 wherein each of said vertical wall support legs include:

a plurality of nested support members, whereby said support members may be moved relative to one another and telescoped to permit use of said trench shoring apparatus in trenches of varying depths.

12. The trench shoring apparatus of claim 10 wherein each of said vertical support legs include:

an anchoring dagger, said dagger joined to the bottom of each said support leg, whereby said dagger may be inserted into the trench floor preventing horizontal movement of each said support leg when under load from shifting trench wall soils.

13. The trench shoring apparatus of claim 12 wherein said anchoring dagger is pivotally joined to the bottom of each said support leg, whereby each said dagger may be rotated into a position substantially parallel to said support leg reducing the length of said trench shoring apparatus permitting easy storage when not in use.

14. The trench shoring apparatus of claim 10 wherein said anchor means includes:

a plurality of hollow anchor members;

a flexible connecting means joining said anchor members, whereby said flexible connecting means allows said anchoring means to hinge and conform to irregular terrain adjacent to a trench excavation; and, a stake joined to one of said hollow anchor members, said stake adapted to penetrate the earth.

15. The trench shoring apparatus of claim 14 wherein said plurality of hollow anchor members nest within one another and are adapted to be telescopically retracted, whereby the size of said trench shoring apparatus may be reduced allowing easy storage thereof when not in use.

16. The trench shoring apparatus of claim 14 wherein said flexible connecting means comprises:

a flexible strap.

17. The trench shoring apparatus of claim 14 wherein said stake is pivotally joined to one of said hollow anchor members, whereby said stake may be rotated into a position substantially parallel to said adjoining hollow anchor members permitting easy storage when not in use.

18. The trench shoring apparatus of claim 10 wherein said anchor means comprises one of:

a linked chain, a cable, and a fabric strap.

* * * * *